US005340041A

United States Patent [19]

Henning et al.

[11] Patent Number: 5,340,041

[45] Date of Patent: Aug. 23, 1994

[54] WELDED ROTATING ANNULAR PASSAGE SEGMENT FOR COAL PULVERIZERS WITH REPLACEABLE VANES AND ADJUSTABLE PASSAGE PORT AREA

[75] Inventors: Thomas L. Henning, Massillon; Robert J. Giammaruti, North Canton, both of Ohio

[73] Assignee: The Babcock & Wilcox Company, New Orleans, La.

[21] Appl. No.: 981,569

[22] Filed: Nov. 25, 1992

[51] Int. Cl.[5] ..... B02C 19/00

[52] U.S. Cl. ..... 241/119; 241/121

[58] Field of Search ..... 241/53, 117, 119, 121, 241/285.2

[56] References Cited

U.S. PATENT DOCUMENTS

| | | | |
|---|---|---|---|
| 2,275,595 | 0/1942 | Schwartz | 83/45 |
| 2,378,681 | 0/1945 | Bailey et al. | 83/45 |
| 2,473,514 | 0/1949 | Ebersole | 241/53 |
| 2,545,254 | 0/1951 | Bice | 241/60 |
| 2,670,138 | 2/1954 | Kung et al. | 241/53 X |
| 2,698,142 | 12/1954 | Crites et al. | 241/53 |
| 2,762,573 | 9/1956 | Culp | 241/53 |
| 4,264,041 | 4/1981 | Kitto, Jr. et al. | 241/57 |
| 4,385,730 | 5/1983 | Kartman | 241/117 X |
| 4,600,157 | 7/1986 | Willach et al. | 241/119 X |
| 4,602,745 | 7/1986 | Maliszewski et al. | 241/119 |
| 4,605,174 | 8/1986 | Maliszewski et al. | 241/52 |
| 4,687,145 | 8/1987 | Dougan et al. | 241/57 |
| 4,721,258 | 1/1988 | Dougan et al. | 241/57 |
| 4,752,037 | 6/1988 | Farris et al. | 241/79.1 |
| 4,860,962 | 8/1989 | Keefer et al. | 241/117 |
| 4,907,751 | 3/1990 | Wark et al. | 241/119 |
| 5,020,734 | 6/1991 | Novotny et al. | 241/119 |
| 5,127,590 | 7/1992 | Bunton | 241/121 X |

FOREIGN PATENT DOCUMENTS

| | | | |
|---|---|---|---|
| 0264103 | 4/1988 | European Pat. Off. | 241/119 |
| 3344223 | 6/1985 | Fed. Rep. of Germany | 241/119 |
| 264156 | 1/1989 | Fed. Rep. of Germany | 241/119 |
| 587989 | 1/1978 | U.S.S.R. | 241/119 |
| 1094617 | 5/1984 | U.S.S.R. | 241/121 |

*Primary Examiner*—Mark Rosenbaum
*Assistant Examiner*—Frances Han
*Attorney, Agent, or Firm*—Daniel S. Kalka; Robert J. Edwards

[57] ABSTRACT

A removable rotating annular passage segment having a removable vane design is achieved by welding individual carbon steel parts into place. A welded passage segment having rails secured by a plurality of ribs is mounted to the grinding table of a pulverizer. Casted vanes are detachably mounted to the welded passage segment and are refitted when worn. The outer wall is adjustable and replaceable because it is welded to the pulverizer. Flow contour plates are welded to both the inner rail and outer wall.

14 Claims, 7 Drawing Sheets

WELDED ROTATING ANNULAR PASSAGE SEGMENT FOR COAL PULVERIZERS WITH REPLACEABLE VANES AND ADJUSTABLE PASSAGE PORT AREA

BACKGROUND OF THE INVENTION

1. Field of the Invention

The present invention relates in general to pulverizers for pulverizing coal, and in particular to a new and useful rotating passage segment design for such pulverizers which includes a removable vane design in the welded rotating passage segment.

2. Description of the Related Art

One type of known coal pulverizing mill or pulverizer is a slow speed, roll-and-race-type pulverizer that uses three large-diameter grinding rolls to crush the coal. Primary air enters the pulverizer through a radial inlet duct, moves into a low-velocity air plenum, and is then accelerated and oriented by a series of stationary passages in a ring that surrounds the grinding zone. At the outlet of the passage, the pulverized coal particles are entrained by the high-speed airflow. The velocity of the air is then reduced in the main pulverizer housing causing the larger particles to be returned directly to the grinding zone for further crushing, while the smaller particles are carried up through the classifier for final sizing.

A large portion of the primary air pressure drop is due to losses across the rotating passage. In some known pulverizers, the primary air pressure drop can be about 40% higher than other mills containing different, rotating passage designs. Due to this higher pressure drop, more fan power is required to operate the mill. This results in a large power penalty due only to the passage design.

A known design illustrated in FIGS. 1 and 2, is a modified version of the earlier stationary passage design of the early 1980's. This design comprises a passage arrangement for a pulverizer having a fixed housing 6 with a central axis. Grinding table 16 rotates around the central axis for pulverizing particles, in particular coal, in a conventional fashion. Grinding table 16 rotates in the rotation direction indicated by the arrow in FIG. 2. Air supplied to an inlet plenum 21 travels upwardly through a passage space provided between an outer passage wall 22 and an inner passage wall 24. The passage space is further divided into individual passage ports 10 by vanes 12, distributed in a circumferentially spaced manner around the vertical axis of the pulverizer. This design also consists of 42 passage ports 10 made up of 14 separate castings mounted to the top and bottom of a grinding table 16. The passage is divided into the individual ports 10 through the use of flow vanes 12. The vanes extend from the passage inlet 10*a* to the passage outlet 10*b* and are included at an angle 14° of 30° from the horizontal and an angle 18° of 15° from the vertical toward a grinding zone 20. The outer passage wall 22 is stationary while the remainder of the passage including its inner wall 24 and the vanes 12 is rotated with the grinding table 16. The air flow is initially oriented by a tear-drop shape 12*a* at the leading edge of the vane 12 and is accelerated to promote a uniform velocity profile over an airfoil shape 12*b* on a portion of the upper surface. Grinding table 16 rotates within a housing 6, about a vertical axis. Wall 22 is supported in the housing and the housing encloses zone 20. The function of the vanes to accelerate and orient the flow through the passage is described in U.S. Pat. No. 4,264,041.

Other pertinent existing prior art relating to pulverizer passage designs are U.S. Pat. No. 2,275,595 (Schwartz '595); U.S. Pat. No. 2,378,681 (Bailey, et al. '681); U.S. Pat. No. 2,473,514 (Ebersole, '514); and U.S. Pat. No. 2,545,254 (Bice '254), U.S. patent application Ser. Nos. 07/858,255 and 07/882,733; all of which are assigned to The Babcock & Wilcox Company. Schwartz '595, discloses curved annular passages fanning a passage discharging scavenging air in the direction of the grinding elements. Bailey, et al. '681, discloses a design for constant air velocity through the passage. Ebersole '541, discloses an adjustable passage, and Bice '254, discloses an eccentric passage design for air distribution. The rotating passage is constructed of 14 individual segments. Each segment includes the vane 12, airfoil 12*b*, and inner wall 24 being casted as one individual piece. In most cases, only the vanes wear out and need replacement during plant maintenance. Due to the present manufacturing designs of rotating passages, the entire passage segment must be replaced instead of only the worn area. This results in a more time-consuming maintenance period which burdens the customer. The one-piece design of current rotating passage segments result in a more complicated retrofit.

SUMMARY OF THE INVENTION

The present invention involves an improved rotating passage design which has a removable vane design in the welded rotating passage segment. This removable vane design in the welded rotating passage segment is achieved by first machining carbon steel into individual parts which are then welded into place. The passage vane is manufactured by casting and modified to allow mounting to the welded passage segment. The cast passage vane is then bolted to the segments once any sizing modifications to the vane, if needed are, performed.

An object of the invention is to provide a welding rotating passage design with the ability to remove and attach individual vane segments, so that worn or damaged vanes may be replaced on an individual basis as needed.

Another object of the invention is to provide a welded rotating passage design that accommodates various vane designs to be installed to custom sizes to meet the customer's specific needs.

A further object of the invention is to provide a manufacturing method to allow for a more precise flow area because only the vanes will be made by casting. Thus, dimensional errors inherent in the large segment castings will be reduced due to the easier mold and cast design and the use of machined carbon steel segments.

Another object of the invention is to provide a welded rotating passage segment that will continue to take advantage of the pressure reduction features found in casted rotating passages but at a lower manufacturing cost.

A further object of the invention is to provide a welded rotating passage that can use cast replaceable vane segments, which will further reduce dimensional errors and improve cost effectiveness.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which the preferred embodiments of the invention are illustrated.

DESCRIPTION OF THE PREFERRED EMBODIMENTS

Figure 1:
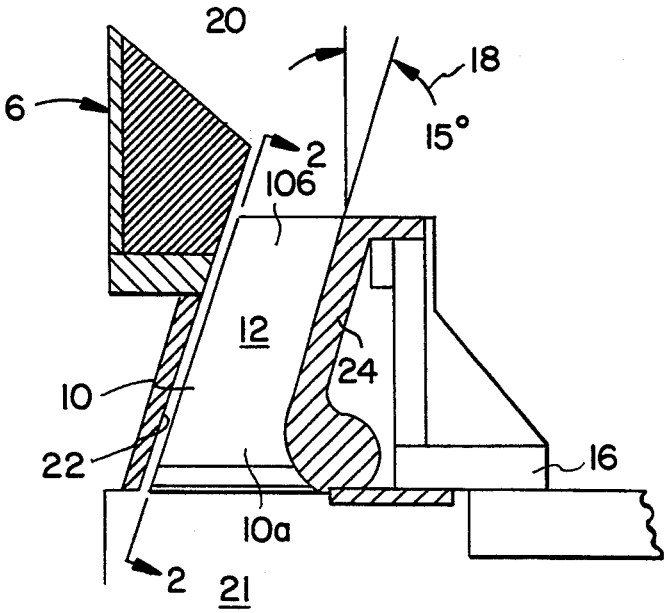
FIG. 1 PRIOR ART
FIG. 1 is a vertical sectional view of the passage area for a known air-swept pulverizer or mill.
Figure 2:
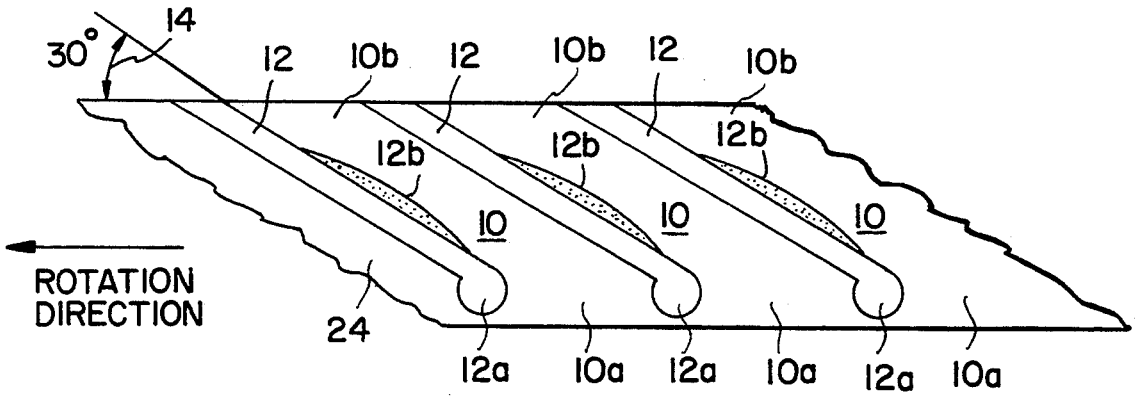
FIG. 2 PRIOR ART
FIG. 2 is a vertical elevational view taken along line 2—2 of FIG. 1.
Figure 3:
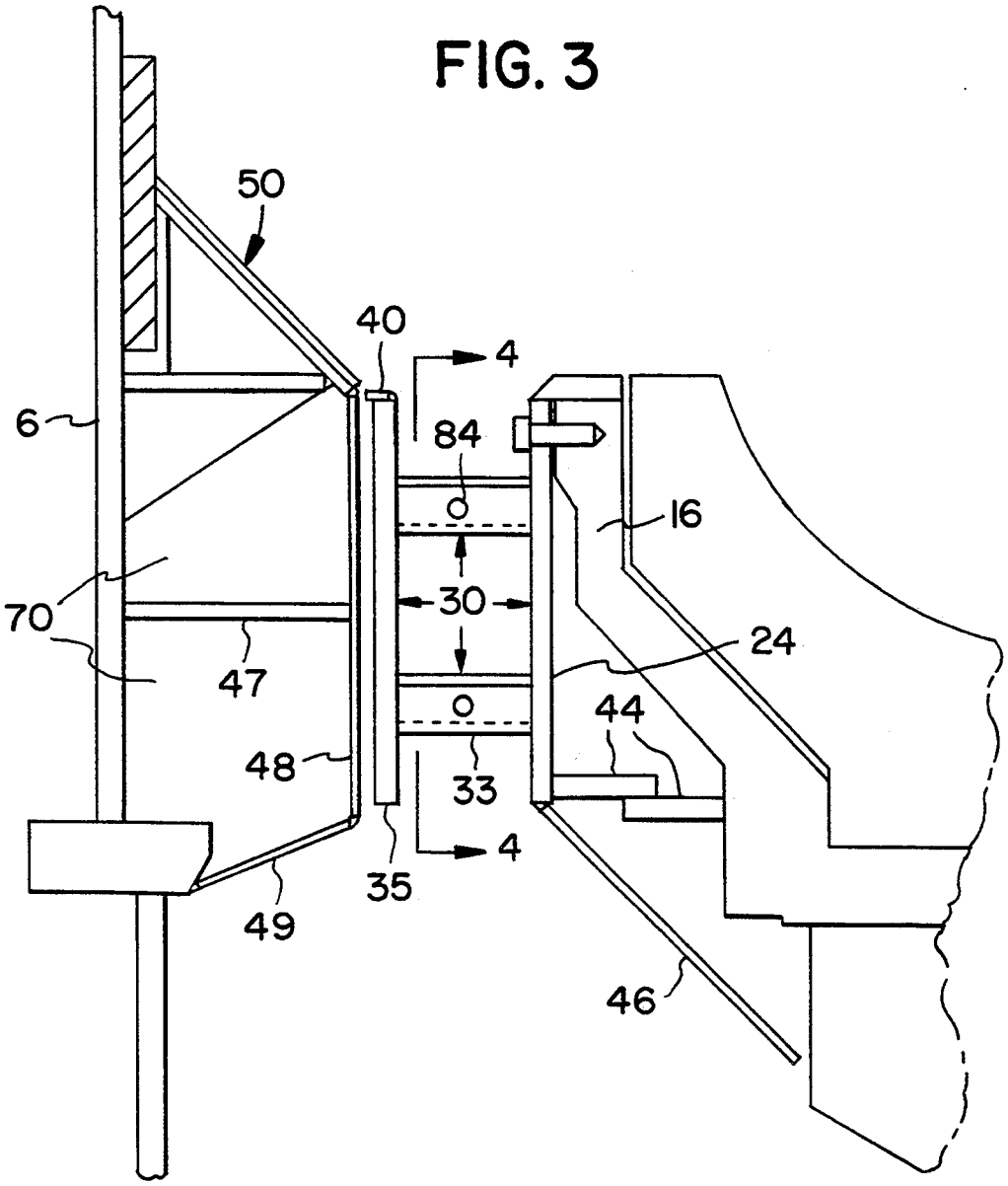
FIG. 3 is a vertical sectional view of the passage area according to the present invention.

In FIG. 3 the invention embodied therein comprises a replaceable passage arrangement for a pulverizer having a fixed housing 6 with a central axis. The replaceable passage design consists of a passage segment generally designated 30 which comprises a number of individual parts which are attached or welded together. Such parts could be made up of carbon steel, which is easy to weld. The passage segment 30 has an inner rail 24 and outer rail 35 which are spaced parallel from each other. The inner rail 24 and outer rail 35 are secured in position by a plurality of ribs 33. The passage segment 30 is mounted with fasteners and/or welding, to the grinding table 16.

The replaceable passage segment 30 can be used in series by mounting each segment 30 about the axis of the housing 6 of the pulverizer.

The outer wall 48 is also replaceable. The brace 47 is secured to the housing 6 and provides support for the outer wall 48. An outer wall flow contour plate 49 forms an inlet cone around the axis of the pulverizer. The outer wall flow contour plate 49 is inclined approximately at a 70° angle with the housing 6 of the pulverizer.

An inner wall flow contour plate 46 is also provided and is replaceable due to it being welded to the inner rail 24. The inner wall flow contour plate 46 also forms an inner wall inlet cone around the axis of the pulverizer and is inclined at approximately a 45° angle with the housing 6.

A ledge cover assembly generally designated 50 is provided between the housing 6 and the outer wall 48. The ledge cover assembly 50 is supported and inclined at approximately at 45° angle at both the housing 6 and the outer wall 48.

Figure 10:
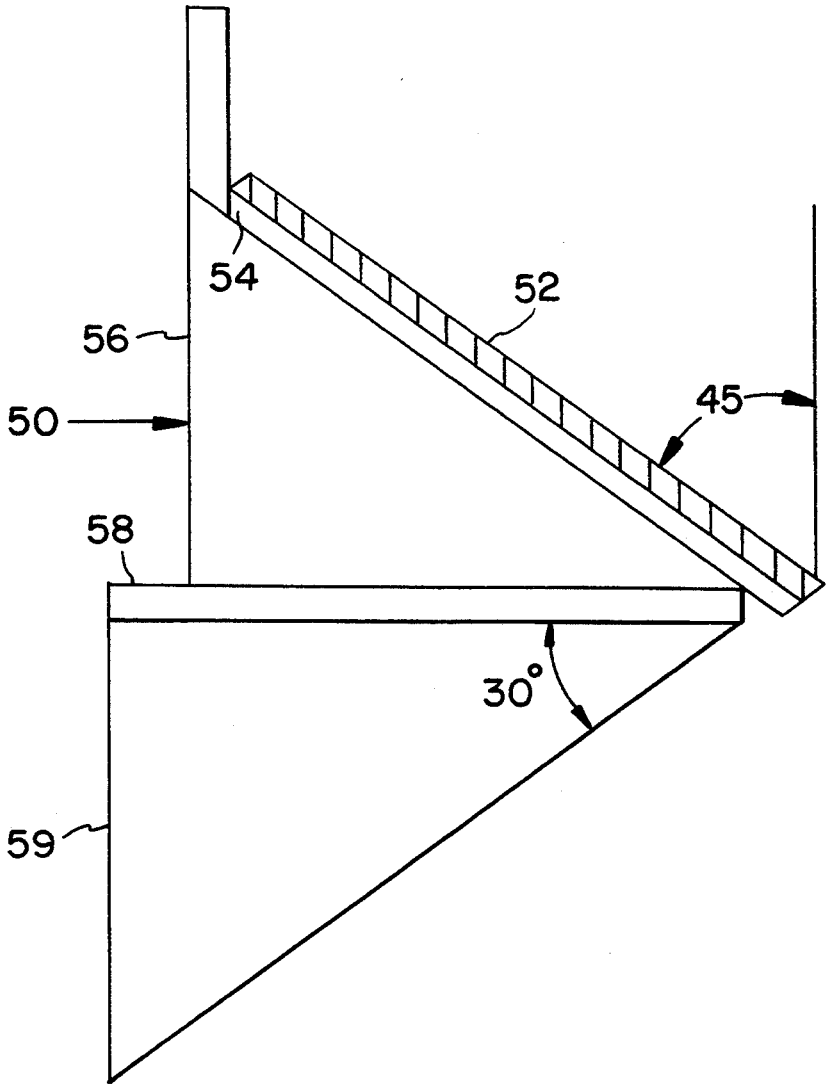
FIG. 10 is a side elevational view of a ledge cover assembly.
Figure 11:
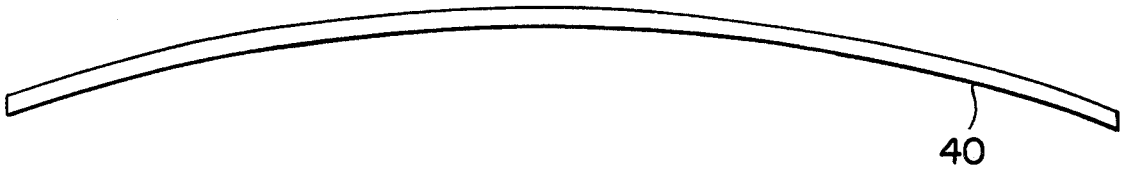
FIG. 11 is a partial top plan view of a gap adjuster segment.

FIG. 10 shows that the ledge cover assembly 50 is comprised of a backing plate 54 which is inclined between the housing 6 and the outer wall 48 and contains a plurality of abrasion resistant material 52 in order to protect the passage area. A backing support 56 is a plate which extends from the backing plate 54 to a support ledge 58. The support ledge 58 is positioned horizontally within the pulverizer to a top edge of the outer wall 48. A gusset plate 59 adds further support to the support ledge 58 and is positioned directly beneath the support ledge 58.

Figure 4:
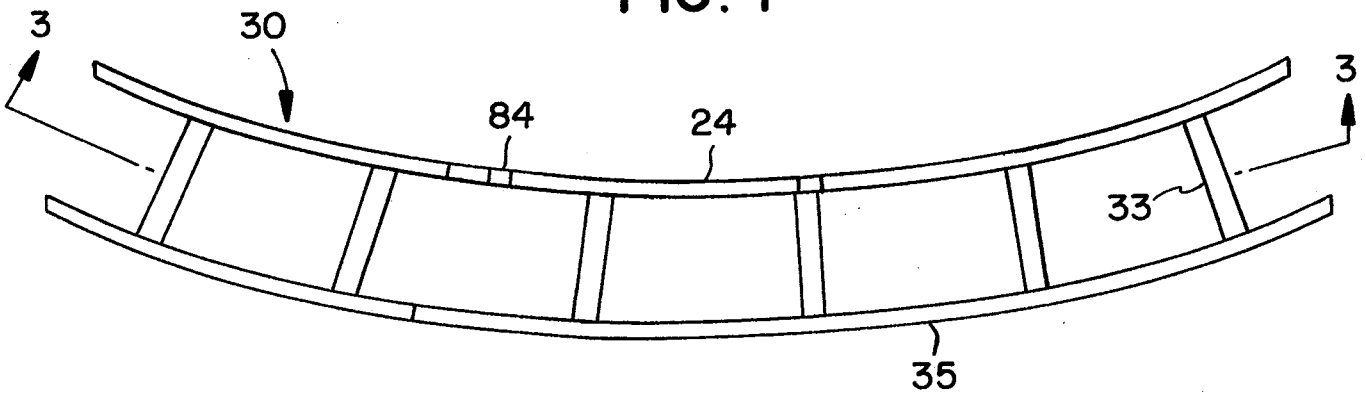
FIG. 4 is a partial top plan view of a passage segment.
Figure 6:
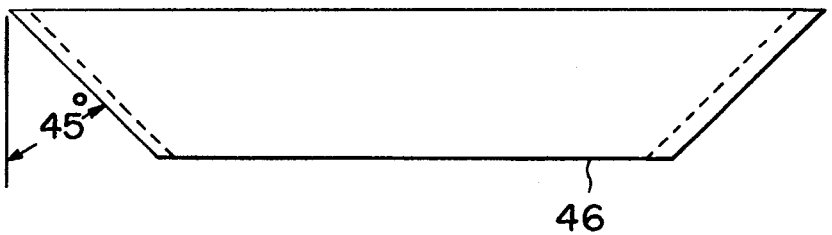
FIG. 6 is a side sectional view of an inner wall inlet contour plate.
Figure 5:
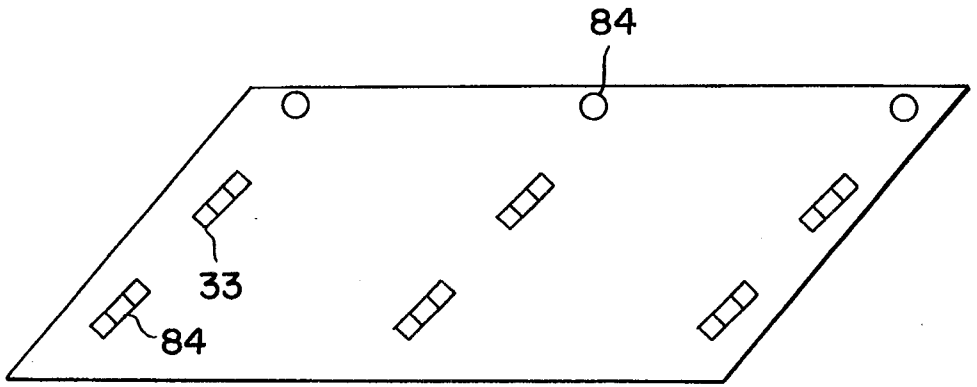
FIG. 5 is a side sectional view taken along lines 3—3 of FIG. 4.
Figure 7:
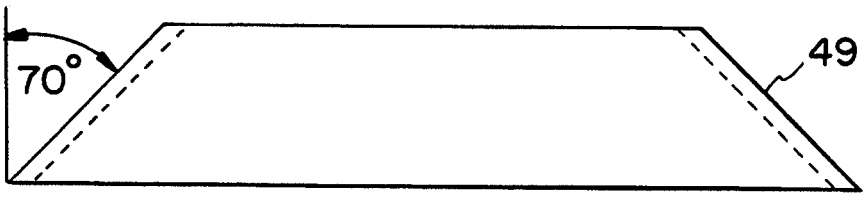
FIG. 7 is a side sectional view of an outer wall inlet contour plate.
Figure 8:
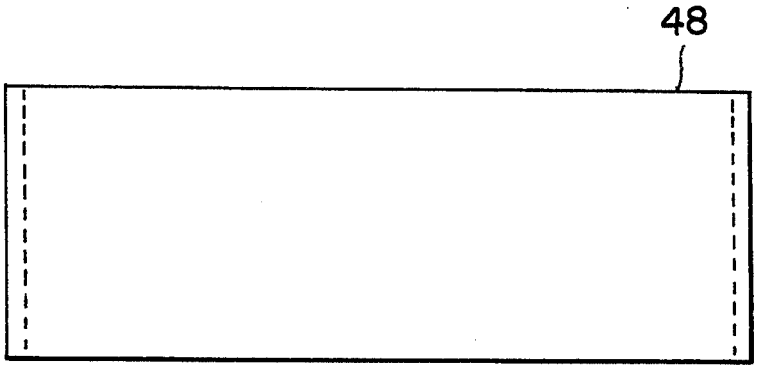
FIG. 8 is a front elevational view of an outer wall.
Figure 9:
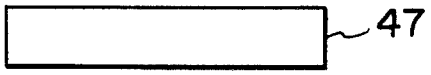
FIG. 9 is a side sectional view of a brace for the outer wall.

FIG. 5 is a side sectional view of the passage segment 30 taken along 3—3 of FIG. 4. The passage segment 30 is mounted to the grinding table 16 through the use of screw apertures 84 bored into the passage segment 30. The passage segment 30 is capable of supporting a plurality of casted vanes 80 (FIG. 13) which are mounted onto the passage segment 30 through the use of cap screws 82. The cap screws 82 are fitted into the screw apertures 84 bored throughout.

FIG. 5 shows that the screw apertures can be bored into the ribs 33 of the passage segment 30. In turn, the vanes (FIGS. 13 & 14) 80 are secured into the ribs 33 through the use of the cap screws 82 being fitted into the screw aperture 84.

A gap seal 40 is provided along the top edge of the outer rail 35 (FIG. 3) in order to seal the plenum flow. The gap seal 40 along with the ledge cover assembly 50 provide both a seal for the air plenum flow and a wear-resistant surface within the pulverizer 6.

Figure 12:
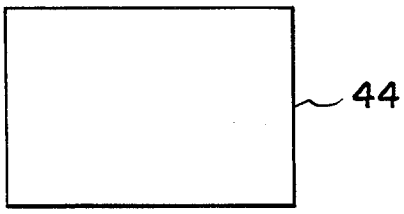
FIG. 12 is a top plan view of a support clip.

FIG. 12 shows a support clip 44 for the passage segment.

Figure 13:
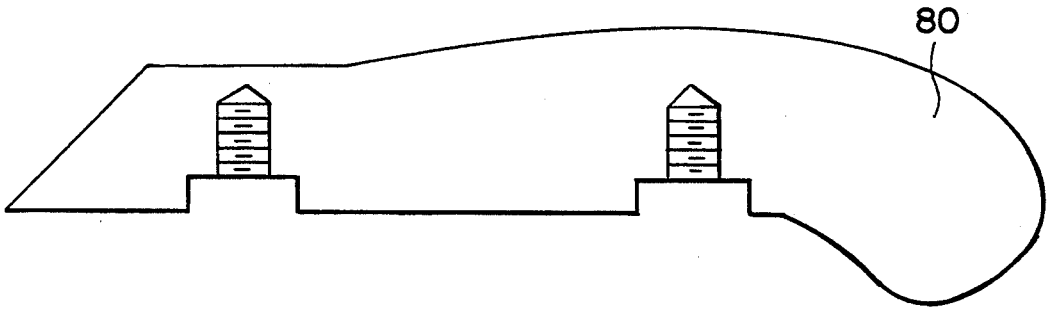
FIG. 13 is a side view of a casted vane.
Figure 14:
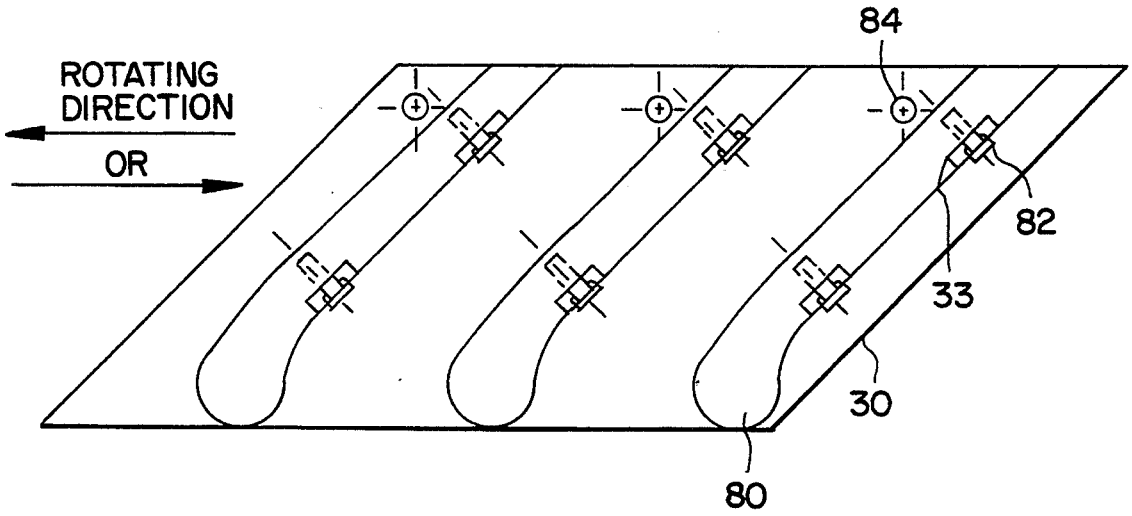
FIG. 14 is a side view taken along 4—4 of FIG. 3 with the casted vanes (FIG. 13) attached.

FIGS. 13 & 14 shows that the casted vanes 80 in conjunction with the cap screws 82 allows for the vanes 80 to be easily refitted upon wearing out.

Refractory 70 such as Kaowool® is provided in the gaps or cavities left in areas behind the outer wall 48. The refractory 70 is used to prevent coal particles from collecting and posing a potential fire hazard.

While specific embodiments of the invention have been shown and described in detail to illustrate the application of the principles of the invention, it will be understood that the invention may be embodied otherwise without departing from such principles.

What is claimed is:

1. A replaceable passage arrangement for a pulverizer, the passage arrangement comprising:

a fixed housing having an axis and defining an inlet plenum for air into a pulverizer and a grinding zone where air picks up and conveys particles pulverized in the pulverizer;

a grinding table mounted for rotation about the axis in the housing;

a plurality of passage segments connected to the grinding table and positioned in the housing, each of said passage segments having an inner rail and secured in position by at least one rib connected thereto;

an outer wall mounted to the housing between the grinding table and the housing, the outer wall being spaced outwardly of the grinding table and defining a passage space therebetween;

an inner wall inlet contour plate inclined and mounted to the inner rail, and an outer wall inlet contour plate inclined and mounted to the outer wall and housing, the inner wall and the outer wall inlet contouring plates acting as a channeling inlet plenum into the passage space;

a ledge cover assembly mounted between the outer wall and the housing for protecting the passage segment; and a plurality of vanes detachably mounted to the passage segments and extending radially from the inner rail for dividing the passage space into a plurality of circumferentially spaced passage ports between the inner and outer rails.

2. A replaceable passage arrangement according to claim 1, wherein the outer wall is secured to the housing by a plurality of support braces.

3. A replaceable passage arrangement according to claim 1, wherein each passage segment is constructed of carbon steel.

4. A replaceable passage arrangement according to claim 1, wherein the passage segments are formed by welding.

5. A replaceable passage arrangement according to claim 1, wherein the vanes are casted.

6. A replaceable passage arrangement according to claim 1, wherein the inner wall inlet contour plate is inclined at approximately a 45° angle with the housing and the outer wall inlet contour plate is inclined at approximately a 70° angle with the housing and the outer wall.

7. A replaceable passage arrangement for a pulverizer, the passage arrangement comprising;

a fixed housing an axis and defining an inlet. plenum for air into a pulverizer and a grinding zone where air picks up and conveys particles pulverized in the pulverizer;

a grinding table mounted for rotation about the axis in the housing;

a plurality of passage segments connected to the grinding table and positioned in the housing, each of said passage segments having an inner rail and an outer rail arranged parallel to each other and secured in position by a plurality of ribs connected between the inner rail and the outer rail, the ribs positioned perpendicular to the inner rail and the outer rail;

an outer wall mounted to the housing between the grinding table and the housing, the outer wall being spaced outwardly of the grinding table and defining a passage space therebetween;

an inner wall inlet contour plate inclined and mounted to the inner rail, and an outer wall inlet contour plate inclined and mounted to the outer wall and housing, the inner wall and the outer wall inlet contouring plates acting as a channeling inlet plenum into the passage space;

a ledge cover assembly mounted between the outer wall and the housing for protecting the passage segment, and a gap seal mounted to the outer rail for preventing plenum flow; and a plurality of vanes detachably mounted to the passage segment and extending radially between the inner and outer rails for dividing the passage space into a plurality of circumferentially spaced passage ports between the inner and outer rails.

8. A replaceable passage arrangement according to claim 7, wherein each rib has a screw aperture bored therethrough for receiving and securing the vanes,

9. A replaceable passage arrangement according to claim 8, wherein the vanes are secured to the ribs by cap screws.

10. A replaceable passage arrangement according to claim 7, wherein the passage segments are mounted between the grinding table and the outer wall and are mounted to a periphery of the grinding table.

11. A replaceable passage arrangement according to claim 7, wherein the passage segments have a series of apertures therethrough which align with a series of prearranged threaded apertures on a periphery of the grinding table, used for mounting the passage segments to the grinding table.

12. A replaceable passage arrangement according to claim 7, wherein each passage segment has a width range of approximately 1 to 10 inches.

13. A replaceable passage arrangement for a pulverizer, the passage arrangement comprising:

a fixed housing having an axis and defining an inlet plenum for air into a pulverizer and a grinding zone where air picks up and conveys particles pulverized in the pulverizer;

a grinding table mounted for rotation about the axis in the housing;

a plurality of passage segments connected to the grinding table and positioned in the housing, each of said passage segment having an inner rail and an outer rail which are spaced parallel from each other;

an outer wall mounted to the housing between the grinding table and the housing, the outer wall being spaced outwardly of the grinding table and defining a passage space therebetween;

an inner wall inlet contour plate inclined and mounted to the inner rail, and an outer wall inlet contour plate inclined and mounted to the outer wall and housing, the inner wall and the outer wall inlet contouring plates acting as a channeling inlet plenum into the passage space;

a ledge cover assembly mounted between the outer wall and the housing for protecting the passage segments, said ledge cover assembly including a backing plate positioned on an incline between the housing and the outer wall at approximately a 45° angle, a support ledge positioned horizontally within the pulverizer to a top edge of the outer wall, a backing support plate extending from the backing plate to the support ledge, and a gusset plate positioned directly beneath the support ledge;

a gap seal mounted to the outer rail for preventing plenum flow; and a plurality of vanes detachably mounted to the passage segment and extending radially between the inner and outer rails for dividing the passage space into a plurality of circumferentially spaced passage ports between the inner and outer rails.

14. A replaceable passage arrangement according to claim 13, wherein the backing plate has a plurality of abrasion resistant material arranged on an upper surface of the backing plate.

* * * * *